United States Patent [19]

Washizuka et al.

[11] 4,005,403

[45] Jan. 25, 1977

[54] INFORMATION STORAGE AND FREQUENCY CONVERTER FOR LIQUID CRYSTAL DISPLAY

[75] Inventors: Isamu Washizuka, Kyoto; Hirohide Nakagawa, Sakurai, both of Japan

[73] Assignee: Sharp Kabushiki Kaisha, Osaka, Japan

[22] Filed: Feb. 28, 1975

[21] Appl. No.: 553,933

[30] Foreign Application Priority Data

Mar. 1, 1974 Japan ..... 49-24352

[52] U.S. Cl. ..... 340/336; 340/324 M; 340/166 EL

[51] Int. Cl.[2] ..... G09F 9/32

[58] Field of Search ..... 340/336, 324 R, 324 M, 340/166 EL, 343

[56] References Cited

UNITED STATES PATENTS

| | | | |
|---|---|---|---|
| 3,280,341 | 10/1966 | DuVall | 340/336 |
| 3,723,749 | 3/1973 | Shapiro | 340/336 |

*Primary Examiner*—Marshall M. Curtis
*Attorney, Agent, or Firm*—Stewart and Kolasch, Ltd.

[57] ABSTRACT

A general-purpose LSI (large-scale integrated circuit) computation circuit provides segment signals of high frequency at respective ones of its output terminals for displaying the computation results. It is necessary to provide a pulse frequency and pulse width converter in order to adapt the segment signals from the computation circuit to a form compatible with liquid crystal display units. There are provided flip-flops and normally closed switches for feeding the output signals of the flip-flops back to the input terminals of the flip-flops in order to temporarily maintain the segment signals within the converter. The input terminals of the flip-flops are connected with the respective ones of the output terminals of the computation circuit through normally open switches. The input terminals of the flip-flops are also connected with the respective segment electrodes of the liquid crystal display units. Synchronization between closing of the normally open switches and opening of the normally closed switches enables updating of the contents of the flip-flops, thereby achieving the reduction of the necessary number of terminals for the converter.

7 Claims, 9 Drawing Figures

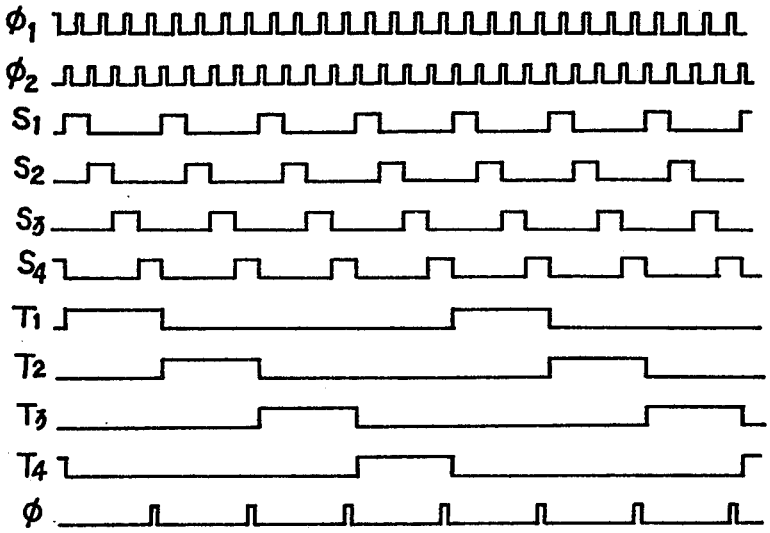
FIG. 4
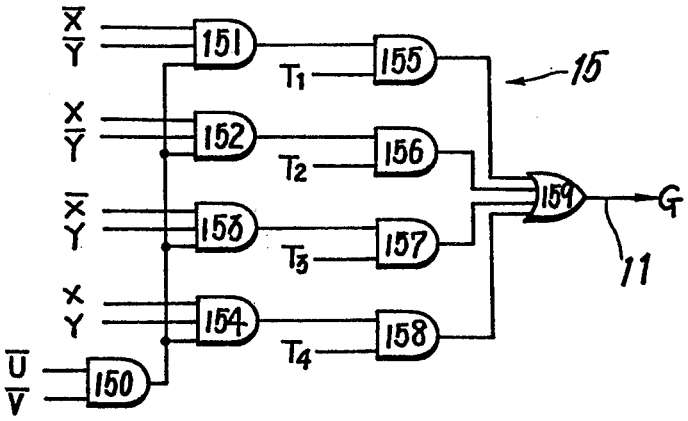
FIG. 8 (Gate Control Circuit -15-)

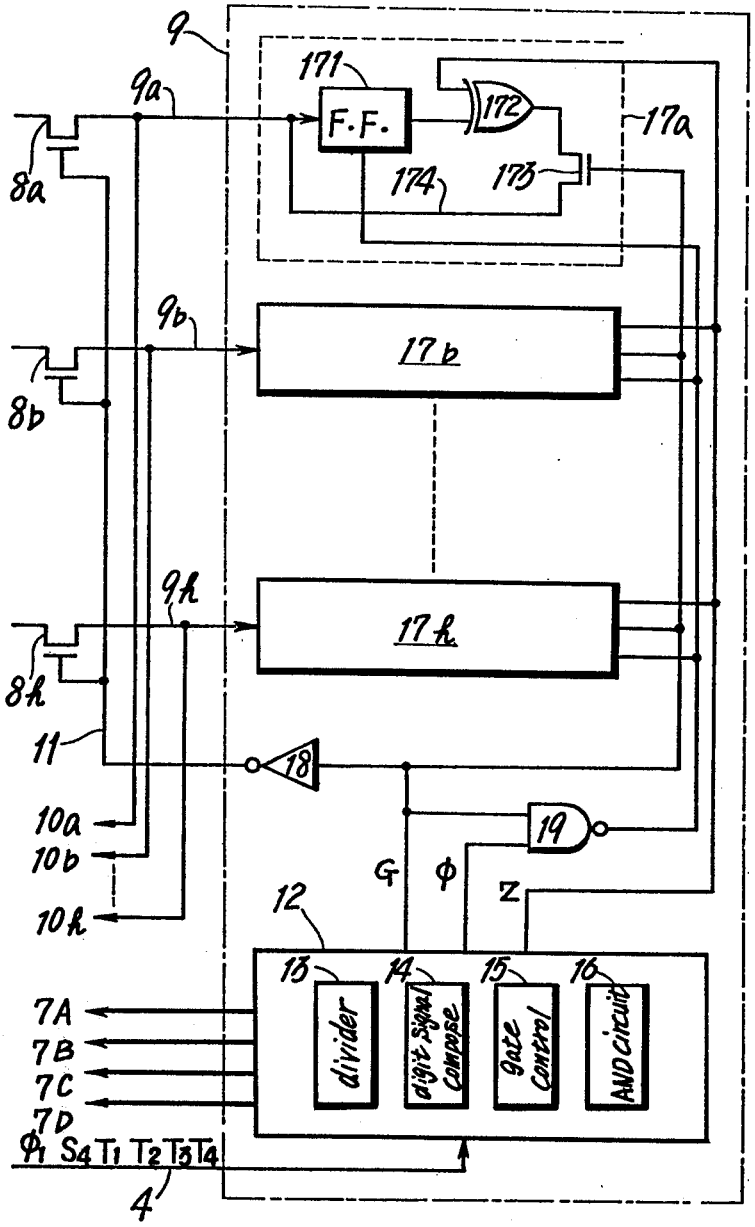
FIG. 5 (Converter -9-)

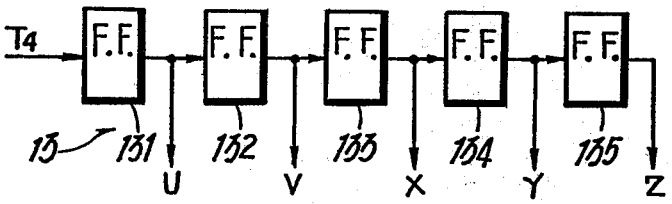
FIG. 6 (Frequency Divider -13-)
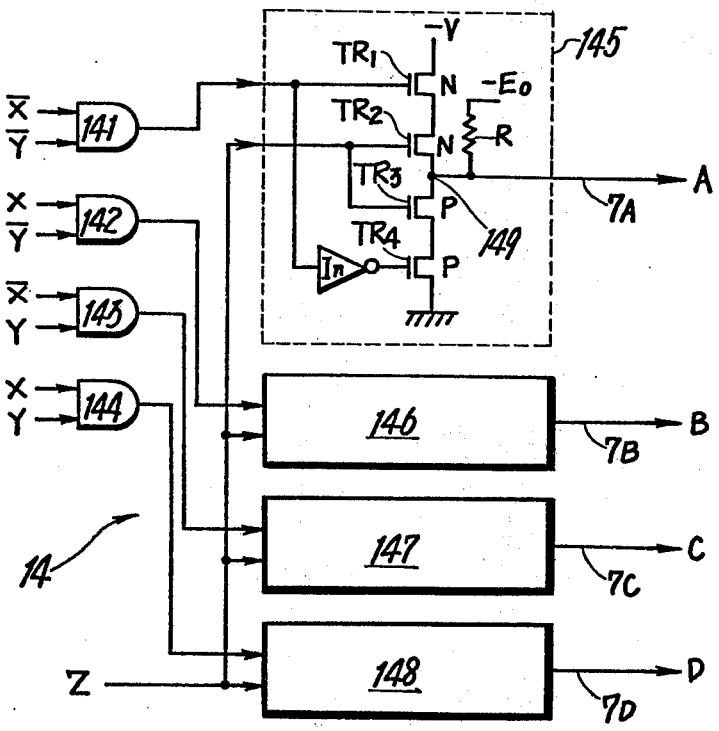
FIG. 7 (Digit Signal Composing Circuit -14-)

INFORMATION STORAGE AND FREQUENCY CONVERTER FOR LIQUID CRYSTAL DISPLAY

BACKGROUND OF THE INVENTION

The present invention relates to a liquid crystal drive network for converting segment signals having a high frequency and derived from a general-purpose LSI (large-scale integrated circuit) computation circuit to a form suited for liquid crystal display units.

An LSI computation circuit generally provides segment display signals for plural digits in a time division fashion in order to reduce the necessary number of the output terminals of the LSI computation circuit when multi-digit numeral information is desired to be displayed in an electronic apparatus such as an electronic calculator. A general-purpose LSI computation circuit provides segment display signals at a high division frequency, since the conventional display units such as discharge type character indication tubes and phosphorescence type tubes can respond to signals having a relatively high frequency. It is necessary to provide a pulse frequency and pulse width converter including signal storage elements when the segment display signals from the general-purpose LSI computation circuit are desired to be used for activating liquid crystal display units, since the liquid crystal display units can not respond to the signals having a high frequency.

The conventional converter mainly comprises segment signal input terminals, storage elements and segment signal output terminals, the respective number of which corresponds to the number of the segment signal output terminals of the LSI computation circuit. It is required that the necessary number of terminals of the converter be reduced in order that integrated circuit technology can be applied to fabricate the converter.

OBJECTS AND SUMMARY OF THE INVENTION

Accordingly, an object of the present invention is to provide a liquid crystal drive network for converting segment signals having a high frequency to a form suited for liquid crystal display units.

Another object of the present invention is to provide a novel pulse frequency converter.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objectives, pursuant to the present invention, there are provided flip-flops and normally closed switches for feeding the output signals of the flip-flops back to the input terminals of the flip-flops in order to temporarily store the segment signals within the converter. Connection between the input terminals of the flip-flops and respective ones of the segment signal output terminals of a general-purpose LSI computation circuit is established through normally open switches. The input terminals of the flip-flops are also connected with the respective segment electrodes of the liquid crystal display units. Closing of the normally open switches is synchronized with opening of the normally closed switches, whereby the segment signals are maintained within the converter during a desired time period and updated at a desired time. The necessary number of segment signal terminals of the converter is reduced to half in comparison with the conventional converter.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

FIG. 4 is a waveform diagram showing various signals which occur in the circuit of FIG. 3;

FIG. 5 is a more detailed block diagram of the preferred embodiment of the converter, including storage elements, and a control block comprising a frequency divider, a digit signal composing circuit, a gate control circuit, and an AND circuit;

FIG. 6 is a block diagram of the frequency divider shown in FIG. 5;

FIG. 7 is a block diagram of the digit signal composing circuit shown in FIG. 5;

FIG. 8 is a block diagram of the gate control circuit shown in FIG. 5; and

DESCRIPTION OF THE PREFERRED EMBODIMENTS

Referring now in detail to the drawings, and to facilitate a more complete understanding of the present invention, a liquid crystal drive network of the prior art will be first described with reference to FIG. 1.

Figure 2:
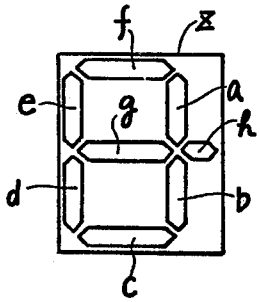
FIG. 2 is a plan view showing an arrangement of segment electrodes and a common electrode in a liquid crystal display unit.

Liquid crystal display units 1A – 1D indicate multi-digit numeral information and the respective display units 1A – 1D comprise segment electrodes *a – h* and common electrodes *z* as shown in FIG. 2. A general-purpose LSI computation circuit 2 provides a converter 5 made of an IC (integrated circuit) with segment output signals 3*a* – 3*h* and synchronization signals 4. Output signals from the converter 5 are applied to the segment electrodes *a – h* of the respective display units via wires 6*a* – 6*h*, and other output signals for selecting any one of the digits to be displayed are applied to the common electrodes *z* of the display units 1A – 1D through wires 7A – 7D.

The above-mentioned converter 5 of the prior art requires numerous terminals, for example, input terminals connected with wires 3*a* – 3*h* and output terminals connected with the wires 6*a* – 6*h*. The necessary number of the terminals must be reduced when the converter is desired to be fabricated with the use of integrated circuit technology. One of the objects of the present invention is to reduce the necessary number of the terminals of the converter, thereby facilitating the application of integrated circuit technology to fabricate the converter.

Figure 1:
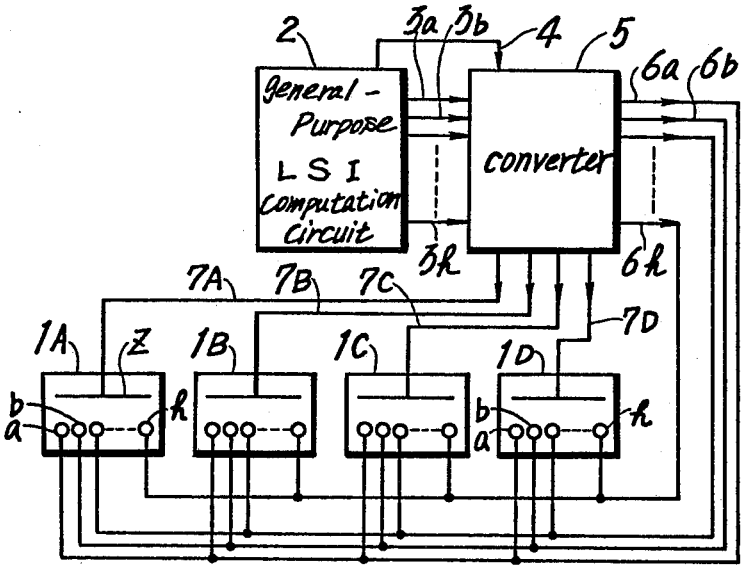
FIG. 1 Prior Art
FIG. 1 is a schematic circuit diagram showing a prior art network for driving liquid crystal display units with the use of segment signals derived from a general-purpose LSI computation circuit.
Figure 3:
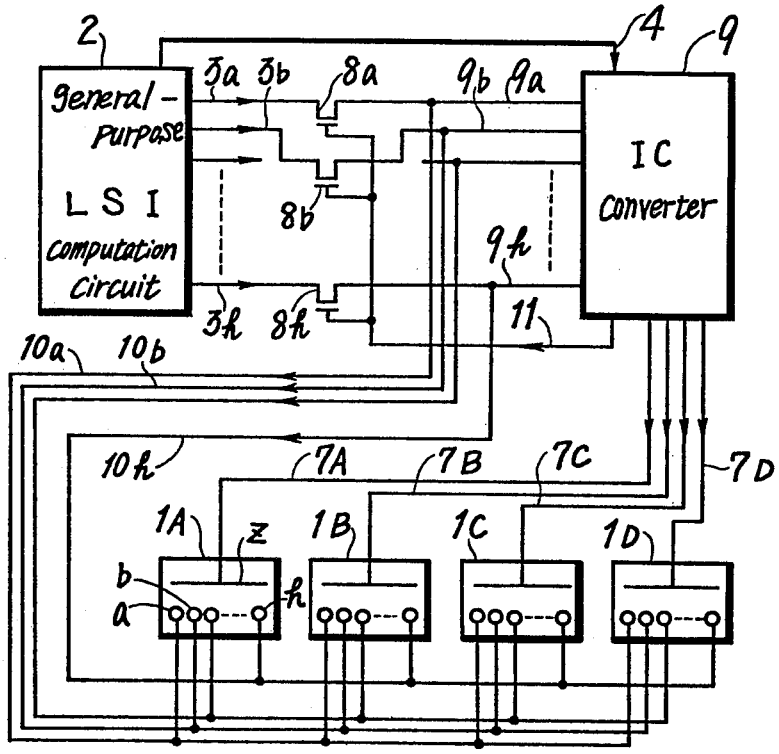
FIG. 3 is a schematic circuit diagram showing a preferred embodiment of a liquid crystal drive network comprising a general-purpose LSI computation circuit, a preferred embodiment of the converter of the present invention, and liquid crystal display units.

Referring now to FIG. 3, a preferred embodiment of the present invention is shown, wherein like elements corresponding to those of FIG. 1 are indicated by like numerals. Application of segment output signals 3*a* – 3*h* from a general-purpose LSI computation circuit 2 to input wires 9*a* – 9*h* of a converter 9 of the present invention is established through MOS transistors 8*a* – 8*h*. The input wires 9*a* – 9*h* are connected with segment electrodes *a* – *h* of the respective liquid crystal display units 1A – 1D through wires 10*a* – 10*h*. Control signals are generated from the converter 9 and applied to the MOS transistors 8*a* – 8*h* through a control wire 11 in order to control the conduction of the MOS transistors 8*a* – 8*h*. Synchronization signals 4 generated from the computation circuit 2 are applied to the converter 9 and the activation of the common electrodes *z* of the respective liquid crystal display units 1A – 1D is controlled by the converter 9 through wires 7A – 7D.

Referring now to FIG. 4, showing various control signals within the general-purpose LSI computation circuit 2, wherein $\phi_1$ and $\phi_2$ show clock pulses, $S_1 - S_4$ show bit signals and $T_1 - T_4$ show digit signals, respectively. The clock pulse $\phi_1$, the bit signal $S_4$ and the digit signals $T_1 - T_4$ are applied to the converter 9 as the synchronization signals 4. The bit signals $S_1 - S_4$ repeatedly develop one during each cycle of the clock pulses $\phi_1$, $\phi_2$ and recur, respectively, every fourth appearance of the clock pulses $\phi_1$, $\phi_2$. The phases of the bit signals $S_1 - S_4$ differ from each other by one cycle of the clock pulses $\phi_1$, $\phi_2$. The digit signals $T_1 - T_4$ repeatedly develop one during each cycle of the bit signals $S_1 - S_4$ and recur, respectively, every fourth appearance of the bit signals $S_1 - S_4$. The phase of the digit signals $T_1 - T_4$ differ from each other by one cycle of the bit signals $S_1 - S_4$. The digit signals $T_1 - T_4$ determine the time period at which the first through fourth digit information within the multi-digit numeral information appears at the output wires 3*a* – 3*h*.

The bit signals $S_1 - S_4$ determine the arithmetic operation period of respective bits within the four bits numeral information, which corresponds to respective digit information. Every arithmetic logical circuit for the respective bits is controlled in such a manner that the introduction of the numeral information is synchronized with the clock pulse $\phi_1$, and the derivation of the numeral information is synchronized with the following clock pulses $\phi_2$.

The converter 9 of the present invention includes a control block 12 as shown in FIG. 5. The control block 12 comprises a frequency divider 13, a digit signal composing circuit 14, a gate control circuit 15, and an AND circuit 16.

Figure 9:
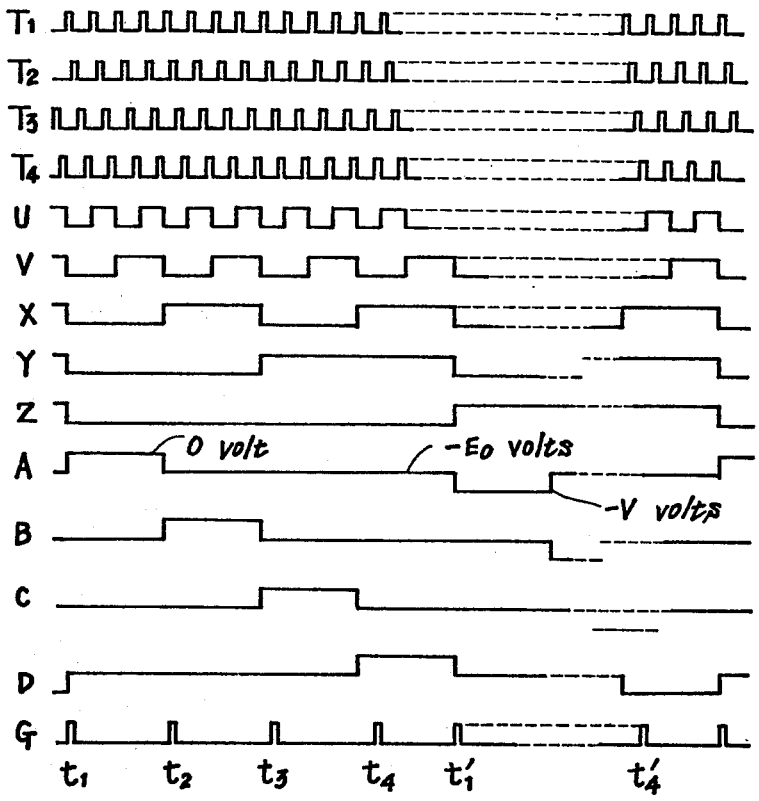
FIG. 9 is a waveform diagram showing various signals which occur in the circuit of FIG. 5.

The frequency divider 13 comprises, as is shown in FIG. 6, flip-flops 131 – 135 for sequentially dividing the digit signal $T_4$ shown in FIGS. 4 and 9 and developing divided signals U, V, X, Y and Z.

Referring now to FIG. 7, there is illustrated the digit signal composing circuit 14 comprising AND circuits 141, 142, 143 and 144, and voltage determining circuits 145, 146, 147 and 148. The respective AND circuits 141, 142, 143 and 144 receive signals of any combinations of the divided signals X, Y and X, Y. The voltage determining circuits 145, 146, 147 and 148 receive the respective output signals of the AND circuits and the divided signal Z. The respective voltage determining circuits 145 – 148 comprise N type MOS transistors $TR_1$ and $TR_2$ and P type MOS transistors $TR_3$ and $TR_4$, which are connected in series. The transistor $TR_1$ is connected with a voltage source of − V volts at one end thereof, and the transistor $TR_4$ is connected with the ground potential at one end thereof. Another voltage source of − Eo volts is connected with a point 149 provided between the transistor $TR_2$ and $TR_3$ through a resistor R. The gate electrode of the transistor $TR_1$ is connected to receive the output of the corresponding AND circuit, whereas the gate electrode of the transistor $TR_4$ is connected to receive inverted output of the corresponding AND circuit through an inverter In. The divided signal Z is applied to the gate electrodes of the transistors $TR_2$ and $TR_3$ and the output signal of the voltage determining circuit is provided at the point 149. The transistors $TR_1$ and $TR_4$ of the voltage determining circuit 145 become ON when the condition of $X \cdot Y$ is satisfied. Under these conditions, when the divided signal Z is not provided, the transistor $TR_3$ becomes ON and hence the voltage level of the point 149 increases to 0 volt. On the contrary, the transistor $TR_2$ becomes ON upon existance of the divided signal Z, and therefore, the voltage level of the point 149 decreases to − V volts. When the condition of $X \cdot Y$ is not satisfied, the transistors $TR_1$, $TR_4$ are OFF, and therefore, the point 149 is maintained at a reference voltage level of − Eo volts. In this way, the voltage determining circuit 145 develops a digit signal A, which is applied to the common electrode of the liquid crystal display unit 1A through a wire 7A. The voltage determining circuits 146, 147 and 148 provide digit signals B, C and D, respectively, in a same manner as discussed above in connection with the voltage determining circuit 145. The respective digit signals B, C and D are applied to the common electrodes of the liquid crystal display units 1B, 1C and 1D through conductors 7B, 7C and 7D.

FIG. 8 shows a detailed construction of the gate control circuit 15. The gate control circuit 15 comprises an AND circuit 150 receiving the divided signals U and V, AND circuits 151, 152, 153 and 154, which respectively receive the various combinations of the divided signals X, Y, X and Y and output signal of the AND circuit 150, AND circuits 155, 156, 157 and 158, one input which receives the output signals of the AND circuits 151 – 154, respectively, and the other input of which receives the digit signals $T_1 - T_4$, respectively, and an OR circuit 159 to which the output signals of the AND circuits 155 – 158 are applied. The OR circuit 159 provides the control wire 11 with a control signal G, which is apparently corresponding to the first appearing digit signals $T_1$, $T_2$, $T_3$ and $T_4$ during the existance period of the respective digit signals A, B, C and D.

The AND circuit 16 develops a logical "and" signal $\phi = \phi_1 . S_4$ shown in FIG. 4 with the use of the clock pulse $\phi_1$ and the bit signal $S_4$.

Referring again to FIG. 5, storage blocks 17*a* – 17*h* are connected with wires 9*a* – 9*h*. The respective storage blocks 17*a* – 17*h* comprise a flip-flop 171 receiving an input signal from a corresponding one of said wires, and a path 174 for feeding the output of the flip-flop 171 back to the input terminal of the flip-flop 171. The path 174 includes an exclusive OR circuit 172 and a MOS transistor 173 in series. The control signal G derived from the control block 12 is applied to the gate electrodes of the transistors 8*a* – 8*h* via an inverter 18 and a wire 11. The control signal G is also applied to the gate electrode of the transistor 173. A NAND circuit 19 receives the control signal G and the logical "and" signal $\phi$, and develops an output for synchronously controlling the flip-flop 171. The input site of the exclusive OR circuit 172 is connected to receive the divided signal Z and the output signal of the flip-flop 171.

The liquid crystal displays unit of FIG. 2 display a numeral information "1" when the segment electrodes *a* and *b* are activated. The segment electrodes *a*, *c*, *d*, *f* and *g* are activated when a numeral information "2" is desired to be displayed. The segment electrodes, *a*, *b*, *c*, *f* and *g* are activated to display a numeral "3" and the segment electrodes *a*, *b*, *e*, *g* and *h* are activated to display a numeral "4". Therefore, when a numeral information "1234" is desired to be displayed, the general-purpose LSI computation circuit 2 develops output signals at the wires 3*a* and 3*b* during a time period when the digit signal $T_1$ exists, and develops output signals at the wires 3*a*, 3*c*, 3*d*, 3*f* and 3*g* during a time period when the digit signal $T_2$ exists. The computation circuit 2 develops output signals at the wires 3*a*, 3*b*, 3*c*, 3*f* and 3*g* during a time period when the digit signal $T_3$ exists and at the wires 3*a*, 3*b*, 3*e*, 3*f*, 3*g* and 3*h* during a time period when the digit signal $T_4$ exists. It will be clear that the wire 3*b* receives the output signals during the time periods of digit signals $T_1$, $T_3$ and $T_4$ but the wire 3*b* does not receive the output signal from the computation circuit 2 during the time period of the digit signal $T_2$ when the numeral information "1234" is desired to be displayed.

The following is concerned with an operation to display the numeral information "1234". When the transistors 8*a* – 8*h* are ON upon receiving the control signal G at a time $t_1$, the storage blocks 17*a* and 17*b* receive the signals since the control signal overlaps with the digit signal $T_1$. The normal conductive transistors within the storage blocks 17*a* and 17*b* become OFF upon receiving the control signal G, and therefore, the feed-back path 174 is disconnected. The signals from the computation circuit 2 are introduced to and stored in the flip-flop 171 upon receiving the logical "and" signal $\phi$ which is supplied by the NAND circuit 19 during the existence period of the control signal. When the control signal is eliminated and hence the transistors 8*a* – 8*h* become OFF and the transistor 173 becomes ON, the output signal of the flip-flop 171 is applied to the segment electrodes *a* and *b* of the liquid crystal display units 1A through 1D via the feed-back path 174 and the wires 10*a* and 10*b*. When the digit signal A exists, only the common electrode *z* of the liquid crystal display unit 1A receives the digit signal, and therefore, only the segment electrodes a and b of the liquid crystal display unit 1A operate to display the numeral "1".

When the digit signal A is eliminated, the liquid crystal display unit 1A ceases to display "1". The contents of the flip-flop 171 in the respective storage blocks is updated upon receiving the control signal G at a time $t_2$, which overlaps with the digit signal $T_2$. The flip-flop 171 within the storage block 17*a* again stores the signals from the computation circuit 2, whereas the flip-flop 171 within the storage block 17*b* loses the information since the storage block 17*b* does not receive the output signals of the computation circuit 2. The storage blocks 17*c*, 17*d*, 17*f* and 17*g* store the information, thereby displaying the numeral information "2" at the display unit 1B during the existence period of the digit signal B. Similarly, the liquid crystal display unit 1C indicates the numeral information "3" during the existence period of the digit signal C, and the liquid crystal display unit 1D indicates the numeral information "4" during the existence period of the digit signal D.

The activating signals applied to the segment electrodes of the liquid crystal display units 1A – 1D must be at a low voltage level when the digit signals A – D are at a high voltage level (0 volt), and at a high voltage level when the digit signals A – D are at a low voltage level (−V volts). The selection of the voltage level of the activating signals applied to the segment electrodes is accomplished by the exclusive OR circuit 172. The output of the exclusive OR circuit 172 is at a low level when both the divided signal Z and the output of the flip-flop 171 are at a high level or both the divided signal Z and the output of the flip-flop 171 are at a low level. The output of the exclusive OR circuit 172 is at a high level when one of the divided signal Z and the output of the flip-flop 171 is at a high level and the other is at a low level. When the flip-flop 171 is constructed so that the flip-flop 171 outputs a low level signal upon receiving the input signal, the activating signals applied to the segment electrodes are at a low level when the divided signal Z is at a low level and the digit signals A – D are at a high level, whereas the activating signals applied to the segment electrodes are at a high level when the divided signal Z is at a high level and the digit signals A – D are at a low level.

As discussed above, the liquid crystal drive network of the present invention can provide the signals suited for activating the liquid crystal display unit by converting the high frequency input signals to the relatively low frequency output signals. The liquid crystal display unit can be satisfactorily activated by the suitable voltage signals derived from the converter. The necessary number of the segment signal terminals of the converter is reduced to half in comparison with conventional converters. The invention being thus described, it will be obvious that the same way be varied in many ways. Such variations are not to be regarded as a departure from the spirit and scope of the invention, and all such modifications are intended to be included within the scope of the following claims.

What is claimed is:

1. A liquid crystal drive network including a source of indication information, and a liquid crystal display unit having a common electrode and segment electrodes, the improvement comprising:

a converter for temporarily storing the indication information;

an input wire including a switching means for introducing the indication information to the converter; and a wiring means for applying the stored information within the converter to the segment electrodes with the use of the input wires to the converter;

said wiring means including second switching means precluding application of stored information to said segment electrodes during introduction to said converter.

2. In a liquid crystal drive network including a general-purpose LSI computation circuit, and a liquid crystal display unit having a common electrode and segment electrodes for displaying information supplied by said computation circuit, the improvement comprising:

a converter including storage means and feed-back wires having first switching means for feeding the output of the storage means back to the input terminal of the storage means;

input wires including second switching means for selectively introducing information from the general-purpose LSI computation circuit to the converter;

a wiring means for connecting the input terminal of the storage means with the segment electrodes; and means for controlling the switching of the first and second switching means to isolate said input wires from said computation circuit during feedback and preclude said feedback during introduction of said information into said storage means through said input wires.

3. The liquid crystal drive network of claim 2 wherein the first switching means are normally closed switching means and the second switching means are normally open switching means.

4. The liquid crystal drive network of claim 2 wherein the storage means are flip-flops.

5. The liquid crystal drive network of claim 3 wherein the normally closed switching means and the normally open switching means are MOS transistors.

6. A frequency converter comprising:

a storage element having an input terminal and an output terminal for temporarily storing input information and developing the stored information;

a normally closed switch for feeding the output of the storage element back to the input terminal of the storage element;

a normally open switch for selectively introducing the input information to the storage element through the input terminal;

an output wire connected with the input terminal of the storage element; and means for simultaneously opening the normally closed switch and closing the normally open switch to introduce said input information to said storage element and preclude feedback of said storage information to said input terminal during such introduction.

7. In a liquid crystal drive network including a source of information to be displayed and a liquid crystal unit having a common electrode and segment electrodes, means for interfacing said source and said liquid crystal unit through a common set of terminals to minimize the member of such terminals comprising:

a feedback type frequency converter for temporarily storing information to be displayed and including input terminals;

input wires including normally open switching means therein leading from said source to said input terminals for selectively introducing said information to said input terminals;

wiring means for connecting the said input terminals to said segment electrodes; and feedback means in said converter for selectively applying said stored information to said segment electrodes through said input terminals.

* * * * *